United States Patent [19]

Larson

[11] Patent Number: 4,489,705

[45] Date of Patent: Dec. 25, 1984

[54] ARCHERY DEVICE

[76] Inventor: Marlow W. Larson, 2735 So. 4050 W., Ogden, Utah 84401

[21] Appl. No.: 99,666

[22] Filed: Dec. 3, 1979

[51] Int. Cl.[3] ..... F41B 5/00

[52] U.S. Cl. ..... 124/35 A

[58] Field of Search ..... 124/35 A, 24 R, 23 R, 124/41 A

[56] References Cited

U.S. PATENT DOCUMENTS

| | | | |
|---|---|---|---|
| 3,937,206 | 2/1976 | Wilson | 124/35 A |
| 4,022,181 | 5/1977 | Fletcher | 124/35 A |
| 4,083,348 | 4/1978 | Fletcher | 124/35 A |
| 4,308,851 | 1/1982 | Kaine et al. . | |

*Primary Examiner*—Richard J. Apley

*Assistant Examiner*—William R. Browne

*Attorney, Agent, or Firm*—M. Ralph Shaffer

[57] ABSTRACT

An archery device comprising a bowstring draw and trigger release mechanism wherein a trigger releasably retains a sear that actuates a release lever, the latter being used for releasing the bowstring loop incorporated in the device. In a preferred form of the invention the sear is provided with a roller or wheel that engages the engaged extremity of the release lever. Structure is provided for adjusting sear pressure relative to the shoulder of the notch provided the trigger; additionally, a locking screw is provided for adjusting the overlap of the sear surface with said shoulder. The finger grip employed posterior of the trigger is made adjustable for convenience of use by the operator.

11 Claims, 9 Drawing Figures

ARCHERY DEVICE

FIELD OF INVENTION

The present invention relates to archery devices and, more particularly, to a new and improved bowstring draw and trigger release device useful in releasing a bowstring whereby the bowstring will immediately propel the arrow to an intended target.

BRIEF DESCRIPTION OF PRIOR ART

In the past a number of different types of bowstring release mechanisms have been devised and are found represented in certain prior art as follows:

U.S. Pat. No. 1,469,610
U.S. Pat. No. 1,855,547
U.S. Pat. No. 2,842,114
U.S. Pat. No. 3,224,427
U.S. Pat. No. 3,490,429
U.S. Pat. No. 3,538,901
U.S. Pat. No. 3,929,120
U.S. Pat. No. 4,004,564
U.S. Pat. No. 4,009,703
U.S. Pat. No. 4,036,204
U.S. Pat. No. 4,083,348
U.S. Pat. No. 4,156,417.

All of the above patents are relevant the subject matter of the present invention and its context wherein some type of mechanism is made useful for firing purposes as for example, by the release of a bowstring loop that temporarily draws back the bowstring of an archery bow preparatory to propelling an arrow carried by the bowstring. The present invention differs from and is an improvement over the above patent disclosures in that a very simple lever mechanism in the form of an elongate sear and a release lever are useful in selectively retaining and then releasing the bowstring loop that is temporarily looped around the bowstring of an archery bow as the bowstring is drawn back in preparation for release. Particularly, both the overlap of sear engagement with the sear and also positionment of the trigger relative to the sear are made adjustable so that both the requisite trigger pressure required for sear release and also the length of travel of such trigger for sear release are made independently adjustable. Preferably, the sear employs a roller or wheel as forward end which engages the engagement extremity of a pivoted release lever useful in restraining and also releasing the bowstring loop employed.

BRIEF DESCRIPTION OF THE PRESENT INVENTION

In the invention a housing includes, rearwardly attached thereto, the hand loop in the form of a chord that is looped over the back of the hand or wrist of the user. A finger grip or rest is made independently adjustable for comfort of the user's hand. Forwardly of the finger rest or finger grip there is provided a pivoted trigger that is spring biased and also provided with adjustment screw means, engagable with the sear employed, for adjusting shoulder overlap of the sear notch of the trigger relative to the upward rearward surface of the sear itself. The sear itself is spring biased by means of return spring and includes an adjustable pivot and also a forward end roller or wheel. The latter engages the lower engagement extremity portion of a pivoted release lever, an upper part of which is provided to retain and also to release a bowstring loop provided also the forward end of the mechanism housing. The release lever and sear are so designed, in a preferred form of the invention, that the lower or engagement extremity of the release lever engages the wheel or roller of the sear at a point so as to preclude release lever movement in the absence of sear release by the trigger, and yet to allow the release lever to pivot past the sear once the trigger is appropriately depressed.

OBJECTS

Accordingly, a principal object of the present invention is to provide a new and improved archery device.

An additional object of the present invention is to provide a new and improved bowstring draw and trigger release mechanism or device.

A further object is to provide in a bowstring draw and release mechanism a spring biased trigger and also a spring biased sear cooperating with a release lever.

An additional object is to provide an improved bowstring draw and trigger release device.

An additional object is to provide a bowstring draw and trigger release device wherein both sear overlap as to the shoulder of the trigger and also sear pressure can be made adjustable, either together or alternatively, and/or independently.

BRIEF DESCRIPTION OF DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

BRIEF DESCRIPTION OF PREFERRED EMBODIMENTS

Figure 4:
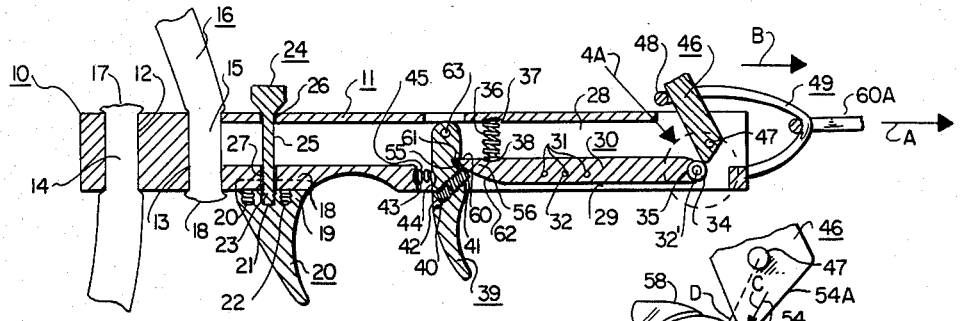
FIG. 4 is a longitudinal vertical section taken along the line 4—4 in FIG. 2.

In FIGS. 1–4A archery device 10, includes a housing 11 formed in the manner seen generally in FIG. 4 and having transverse apertures 12 and 13 which receive the opposite ends 14 and 15 of hand loop 16. The hand loop 16 may be made of a suitable plastic material such that the end surfaces at 17 and 18 are heat enlarged to prevent end-withdrawal of the hand loop from the housing 11.

Housing 11 includes a part at 18 that receives the upper saddle 19 of finger grip 20. The saddle 19 includes a series of threaded apertures 20–22 a respective one of which admits and threadedly receives the threaded end 23 of locking screw 24. The threaded end, of course, will be supplied, the downward extremity of shank 25, the latter passing through apertures 26 and 27. Accordingly, the finger grip 20 may be adjusted back and forth and then locked in place by the locking screw 24, this for maximum comfort for the user's third through fifth fingers.

As in seen in FIG. 4, the housing 11 is a machined part having a hollow interior at 28 terminating at its side in a slot 29. This interior end slot receives a sear 30 having a plurality of apertures 31 one of which selectively accommodates a pivot pin 32'. Sear or sear means 30 likewise includes a pivot pin 33 pivoting roller 34 at the end of the sear as disposed in recess 35. Return spring 36 is a compression spring which is seated in recesses 37 and 38 of housing 11 and sear 30, respectively. Trigger 39 is provided with an askew threaded aperture 40 accommodating adjustment screw 41 and also locking screw 42. These screws are actually aligned as indicated and may comprise Allen screws. Seats 43 and 44 accommodate the opposite ends of compression spring 45.

Figure 1:
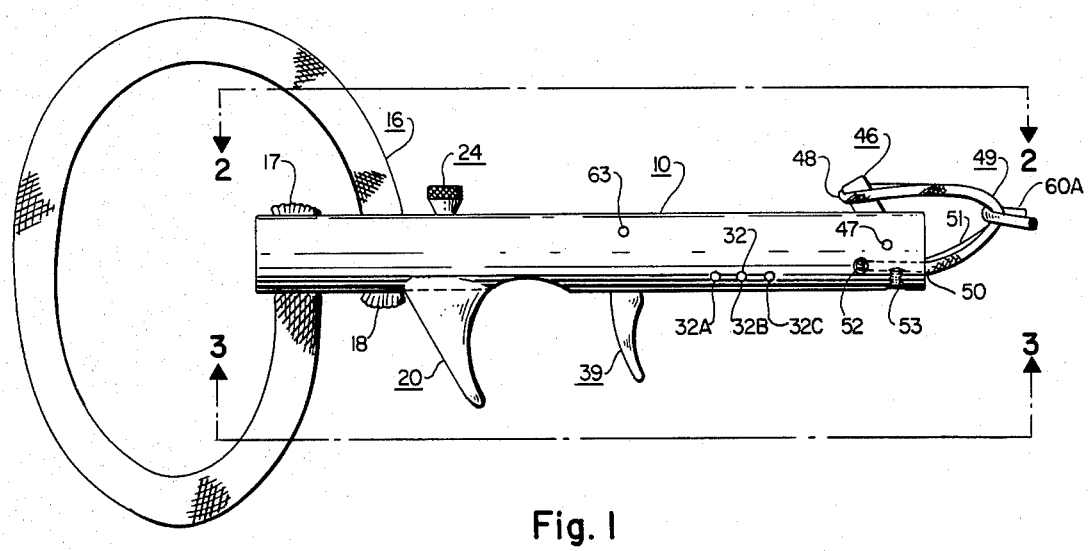
FIG. 1 is a top plan of the invention in one embodiment thereof.
Figure 2:
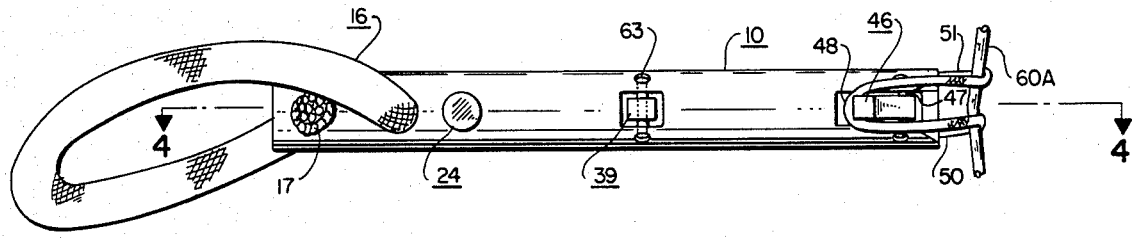
FIG. 2 is a view taken along the line 2—2 in FIG. 1.
Figure 3:
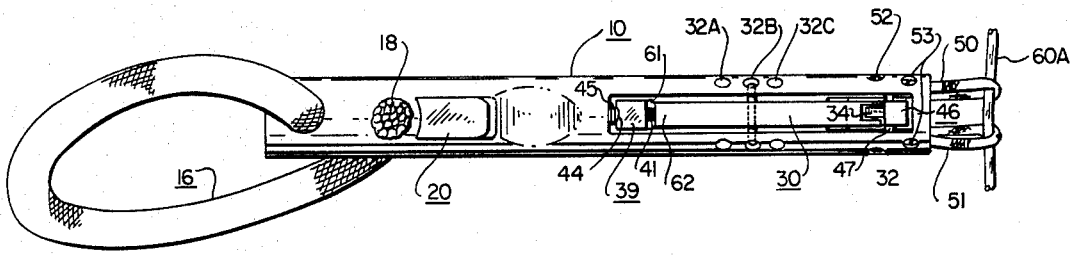
FIG. 3 is a view taken along the line 3—3 in FIG. 1.

At the far end of the housing 11 is pivotally included a release lever 46 mounted by pivot pin 47 to the housing and which retains the rearmost end 48 of bowstring loop 49. The latter has its ends 50 and 51 disposed within the interior area of the housing and positioned in wall apeatures 52, one being shown, the same being disposed on opposite sides of the housing. If desired, the ends may be likewise frayed or heat-enlarged for securement of the loop in place. Also, a pair of set screws 53, one of which is shown in FIG. 1, can be employed to further increase the retention of the bowstring loop 49 in position.

Figure 4A:
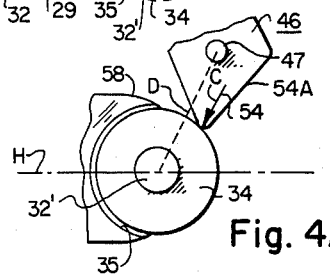
FIG. 4A is an enlarged detail taken along the dotted line 4A in FIG. 4.

FIG. 4A illustrates that the roller or lever engages, above horizontal axis H the external surface 54A of engagement or lower end projection 54 of release lever 46. Accordingly, when the trigger 39 is disposed forwardly as seen in FIG. 4, the sear notch 55 of the trigger engages rear extremity 56 of sear 30. It is noted that the pressure of the bowstring forwardly in the direction of arrow A produces a corresponding force B at the top of release lever 46, thereby producing a pressure in the direction of arrow C, see FIG. 4A, against roller 34. This latter pressure tends to force the rear extremity 56 of sear 30 upwardly against sear notch 55.

Figure 5:
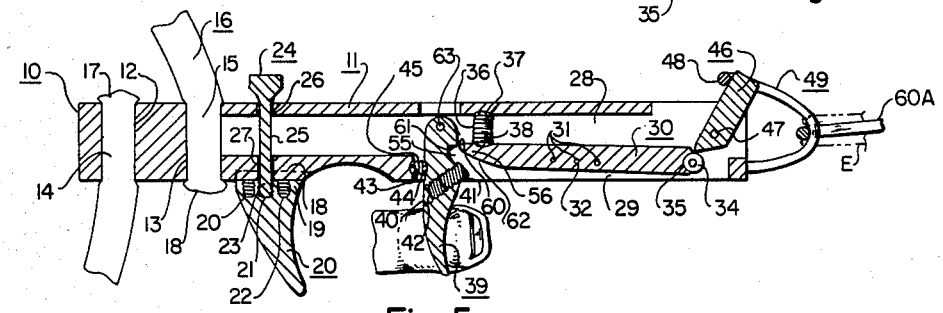
FIG. 5 is a view of the structure at FIG. 4 wherein finger pressure has just depressed the trigger sufficiently so as to release the sear and allow the release lever to pivot so as to tend to release the bowstring loop.

In operation, see FIG. 5, when the trigger 39 is manually depressed by the user's index finger, rear extremity 56 of sear 30 becomes disengaged from notch 55. Accordingly, the pressure against roller 34 above horizontal axis H, as exists at arrow C in FIG. 4A, forces the sear to rotationally displace in a clockwise direction so as to permit engagement extremity 54 to proceed past the axis D joining the centers of pivot pin 47 and pivot pin 32, see again FIG. 4A, whereby the engagement extremity is allowed to ride upwardly relative to the upper roller surface and cam surface 58, thereby permitting the release lever 46 to release bowstring loop 49, see FIGS. 5 and 6, whereupon the bowstring 60A is released for immediately propelling the arrow E shown in dotted lines in FIG. 5.

At this point, it should be noted that the rearward portion 56 of sear 30 includes a rear upper surface 60 cooperating with shoulder 61 of notch 55. The chosen location and protrusion of adjustment screw 41 relative to sear surface 62 will determine the overlap of sear surface 56 relative to shoulder 61 and hence determines the amount of trigger travel required to release the sear from notch 55. This is of great importance to the user since some prefer instantaneous feather-touch release whereas other users prefer a slight movement, to appreciable degree, of the trigger before the sear is released to accomplish the firing of the arrow.

Also, the location of pivot pin 32, disposed in opposite housing apertures 32A–32C, see FIG. 1, determines how much trigger pressure is required to positively release the sear from its notch.

Figure 6:
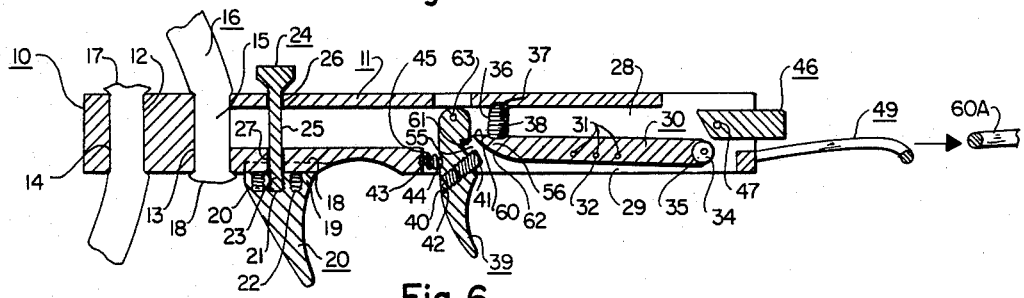
FIG. 6 is similar to FIG. 5 but illustrates that when the trigger is returned, the rearward extremity of the sear now rides upwardly of and beyond the sear engagement notch of the trigger.
Figure 6A:
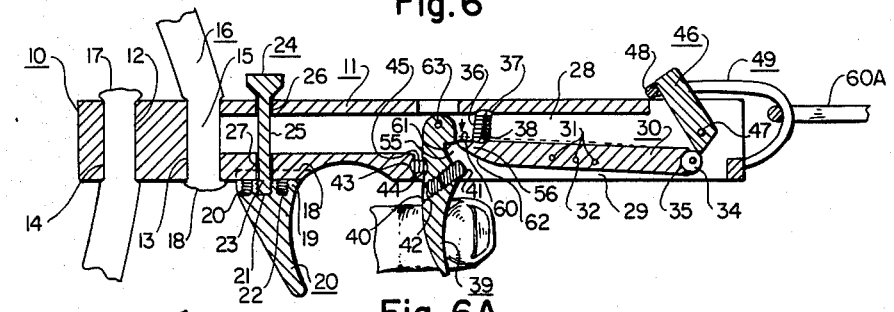
FIG. 6A is similar to FIG. 6 but illustrates the manner in which the release lever can be returned to its initial position so that its engagement extremity again appropriately engages the sear roller, the trigger then being depressed for re-cocking.
Figure 6B:
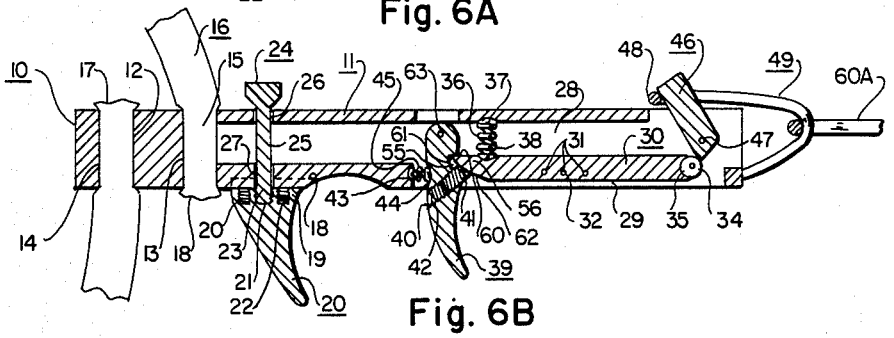
FIG. 6B indicates a re-cocking of the device wherein the trigger is momentarily depressed rearwardly and then allowed to advance forwardly under a spring pressure, whereby the rearward extremity of the sear is brought again in engagement with the sear notch of the trigger.

In continuing a consideration of the further operation of the device, reference is now made to FIGS. 6, 6A and 6B. In FIG. 6 the release lever 46 has completely released bowstring loop 49 and the bowstring 60A has long since left the bowstring so that the arrow is propelled as intended. It is noted that with the depression of trigger 39, surface 60 is now not overlapped by shoulder 61 of notch 55; rather, the rear extremity 56 of the sear is engaging that portion of the trigger which is above notch 55. The same condition exists when lever 46 is re-cocked, see FIG. 6A, with the bowstring loop 49 being disposed over the top 46A of lever 46. However, the rear portion 56 of sear 30 is still not engaged with notch 55. The latter requires the depression, as seen in FIG. 6A, of trigger 39 so as to permit spring 36 to depress the rearmost part of sear 30 such that, see FIG. 6B, portion 56 again comes in engagement with notch 55 such that surface 61 is overlapped by notch shoulder 61.

Accordingly, the device is first fired, then release lever 46 is re-cocked to the position shown in FIG. 6A, and finally, trigger 39 is depressed so as to allow the sear to go from the position shown in FIG. 6A to FIG. 6B whereby a complete re-cocking has been achieved.

Again, if all apertures pluralities are provided as at 31 relative to the sear and 32A–32C relative to the housing, simply a single pivot pin at 32 is used for the chosen fulcrum or pivot point. The shorter the lever arm distance from pin 32 to extremity 56, the greater pressure the bowstring will exert as to the engagement of sear surface 60 with shoulder 61. If a pivot point is chosen for sear 30 such that the lever arm is longer relative to the selected aperture 31 and the rearward extremity, then a progressively less pressure will be involved and transmitted to the engaging surfaces 60 and 61. Accordingly, trigger pulled pressure to effect release can be varied by selection of a proper pivot point relative to sear 30.

While a preferred embodiment has been shown, it will be noted that, conceivably, the roller 34 could be journalled to release lever 46 instead of sear 30. The roller interengagement between sear and lever would still be provided, reducing friction wear.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. An archery bowstring draw and release device including, in combination: a first member provided with a rearwardly disposed handloop and a forwardly disposed bowstring loop; release lever means pivoted to said first member proximate said bowstring loop, having a lower end projection providing an exterior surface thereat, and constructed for releasably retentively receiving said bowstring loop, spring-biased sear means pivoted to said first member rearwardly of said release lever means, said sear means being provided with a pivoted freely-revolvable roller selectively retentively rollingly engaging said exterior surface of said release lever means; and spring-biased trigger means separate from said sear means, pivoted to said first member rearwardly of said sear means, and provided with a notch for selectively, retentively, receivably engaging said sear means, said trigger means being provided with adjustment screw means engaging said sear means for predetermining the extent of engagement of said sear means with said trigger means notch, said release lever means being constructed for return thereof to cocked position prior to recocking of said trigger means.

2. An archery bowstring draw and release device including, in combination: a first member provided with a rearwardly disposed handloop and a forwardly disposed bowstring loop; release lever means pivoted to said first member proximate said bowstring loop, having a lower end projection providing an exterior surface thereat, and constructed for releasably retentively receiving said bowstring loop; spring-biased sear means pivoted to said first member rearwardly of said released lever means, said sear means being provided with a pivoted freely-revolvable roller selectively retentively rolling engaging said exterior surface of said release lever means; and spring-biased trigger means pivoted to said first member and provided with a notch for selectively, retentively, receivably engaging said sear means, said trigger means being provided with adjustment screw means engaging said sear means for predetermining the extent of engagement of said sear means with said trigger means notch, said sear means having plural, individually selectable pivot means.

3. The device of claim 2 wherein said first member is provided with laterally outwardly extending finger grip means adjustably movable forwardly and rearwardly.

4. The device of claim 1 wherein said first member comprises a housing.

5. The device of claim 1 wherein said trigger means is provided with adjustable protuberance means for engaging said sear means whereby to preset the extent of trigger means, sear engagement.

6. The device of claim 1 wherein said trigger means comprises a trigger having a sear-receiving notch in part defined by a shoulder releasably engaging said sear means.

7. In an archery bowstring draw and release device having a housing and a trigger, provided a forwardly-facing sear-receiving, concavely indented notch, pivoted to said housing: an improvement comprising a release element pivoted to said housing forwardly of said trigger and an elongate sear separate from said trigger and said release element, said sear also being pivoted to said housing between said trigger and said release element and extending rearwardly for selectively protruding into and thereby engaging said notch, and said sear being provided with a forwardly extending, axially pivoted roller selectively rollably engaging said release element, said sear being releasably retained by said trigger within said notch, said trigger being provided with an adjustment screw engaging said sear for predetermining the extent of sear-trigger engagement.

8. In an archery bowstring draw and release device including a trigger, a release element, and pivotable sear means interposed between said trigger and said release element for selectively releasing said release element: an improvement wherein said sear means is provided with structure facilitating selectable placement of said sear means' pivot axis.

9. In combination: a first, housing member; a trigger, a sear disposed forwardly of and selectively retained by said trigger and having a roller end, and a release element disposed forwardly of and selectively engaged by said sear, said trigger, sear, and release element being mutually cooperable together and respectively pivoted to said first, housing member, said trigger having a notch receiving said sear and being provided with adjustment screw means engaging said sear for predetermining the extent of cocked-condition sear-trigger engagement at said notch; and roller means pivotally mounted to said roller end of said sear and rollably engaging said release element for producing roller-contact there-between whereby to effect selective pivotal release of said release element upon depression of said trigger.

10. An archery bowstring draw and release device, including, in combination: a housing; a release element having an accessable, flexible elongate member retainer end, a remaining end, and pivot means pivoting said release element to said housing between said ends; a trigger pivoted to said housing rearwardly of said release element, said trigger having a sear-engagement-and-release portion; and a sear, physically spaced apart and separate from said trigger and said release element, having a rear portion selectively retentively engaging said sear-engagement-and-release portion, and also having medial pivot means medially pivotally mounting said sear to said housing, said sear including forward extremity roller means selectively engaging said release element proximate said remaining end thereof for selectively retaining in cocked position, and also selectively releasing to uncocked, flexible-elongate member release position, said release element, whereby to permit said retainer end to move releasably forwardly.

11. In an archery bowstring draw and release device having a housing and a trigger, provided a forwardly-facing sear-receiving, concavely indented notch, pivoted to said housing: an improvement comprising a release element pivoted to said housing forwardly of said trigger and an elongate sear separate from said trigger and said release element, said seal also being pivoted to said housing between said trigger and said release element and extending rearwardly for selectively protruding into and thereby engaging said notch, and said sear being provided with a forwardly extending end selectively movably engaging said release element, said sear being releasably retained by said trigger within said notch, said trigger being provided with an adjustment screw engaging said sear for predetermining the extent of sear-trigger engagement.

* * * * *